US012466673B2

(12) United States Patent
Wanibe

(10) Patent No.: US 12,466,673 B2
(45) Date of Patent: Nov. 11, 2025

(54) PAPER FEEDING CASSETTE AND RECORDING APPARATUS

(71) Applicant: SEIKO EPSON CORPORATION, Tokyo (JP)

(72) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 18/459,965

(22) Filed: Sep. 1, 2023

(65) Prior Publication Data

US 2024/0076149 A1 Mar. 7, 2024

(30) Foreign Application Priority Data

Sep. 5, 2022 (JP) ..... 2022-140545

(51) Int. Cl.
*B65H 1/26* (2006.01)

(52) U.S. Cl.
CPC ..... *B65H 1/266* (2013.01); *B65H 2405/11* (2013.01)

(58) Field of Classification Search
CPC . B65H 1/00; B65H 1/04; B65H 1/266; B65H 2405/11; B65H 2301/517; B65H 2801/06
See application file for complete search history.

(56) References Cited

U.S. PATENT DOCUMENTS 11,279,576 B2 * 3/2022 Matsushima ..... B65H 1/04

FOREIGN PATENT DOCUMENTS

JP H05-124736 A 5/1993
JP 10194477 A * 7/1998

* cited by examiner

*Primary Examiner* — Leslie A Nicholson, III
(74) *Attorney, Agent, or Firm* — WORKMAN NYDEGGER

(57) ABSTRACT

A paper feeding cassette is configured to be inserted into an apparatus and drawn out from the apparatus. The paper feeding cassette includes a placement unit at which a sheet is to be placed, and at least one accommodation unit configured to accommodate an accommodated article. The accommodation unit includes a top plate and a side wall intersecting the top plate. The side wall includes an opening part opened toward an inner side of the paper feeding cassette. The placement unit and the accommodation unit are provided at positions different from each other.

9 Claims, 8 Drawing Sheets

PAPER FEEDING CASSETTE AND RECORDING APPARATUS

The present application is based on, and claims priority from JP Application Serial Number 2022-140545, filed Sep. 5, 2022, the disclosure of which is hereby incorporated by reference herein in its entirety.

BACKGROUND

1. Technical Field

The present disclosure relates to a paper feeding cassette and a recording apparatus.

2. Related Art

For example, as described in JP-A-5-124736, a copier being an example of a recording apparatus has been proposed. The copier performs copying on a sheet. The copier includes a paper feeding cassette that accommodates a sheet. The paper feeding cassette is drawably mounted to a main body. The paper feeding cassette includes a small article accommodation unit, which is an example of an accommodation unit that accommodates a small article. A small article is put in the small article accommodation unit through an opening provided on the upper side thereof.

In a case of the small article accommodation unit of JP-A-5-124736 that includes a recessed part with an opened upper side, there is a risk that an accommodated article may protrude to hinder insertion and drawing-out of the paper feeding cassette.

SUMMARY

A paper feeding cassette to solve the above-mentioned problem is a paper feeding cassette configured to be inserted into an apparatus and drawn out from the apparatus, the paper feeding cassette including: a placement unit at which a sheet is to be placed, and at least one accommodation unit configured to accommodate an accommodated article, in which the accommodation unit includes a top plate and a side wall intersecting the top plate, the side wall includes an opening part opened toward an inner side of the paper feeding cassette, and the placement unit and the accommodation unit are provided at positions different from each other.

A recording apparatus to solve the above-mentioned problem is a recording apparatus including: the paper feeding cassette having the above-mentioned configuration, a feeding unit configured to feed the sheet to be placed on the paper feeding cassette, and a recording unit configured to perform recording on the sheet.

DESCRIPTION OF EMBODIMENTS

Embodiment

Figure 1:
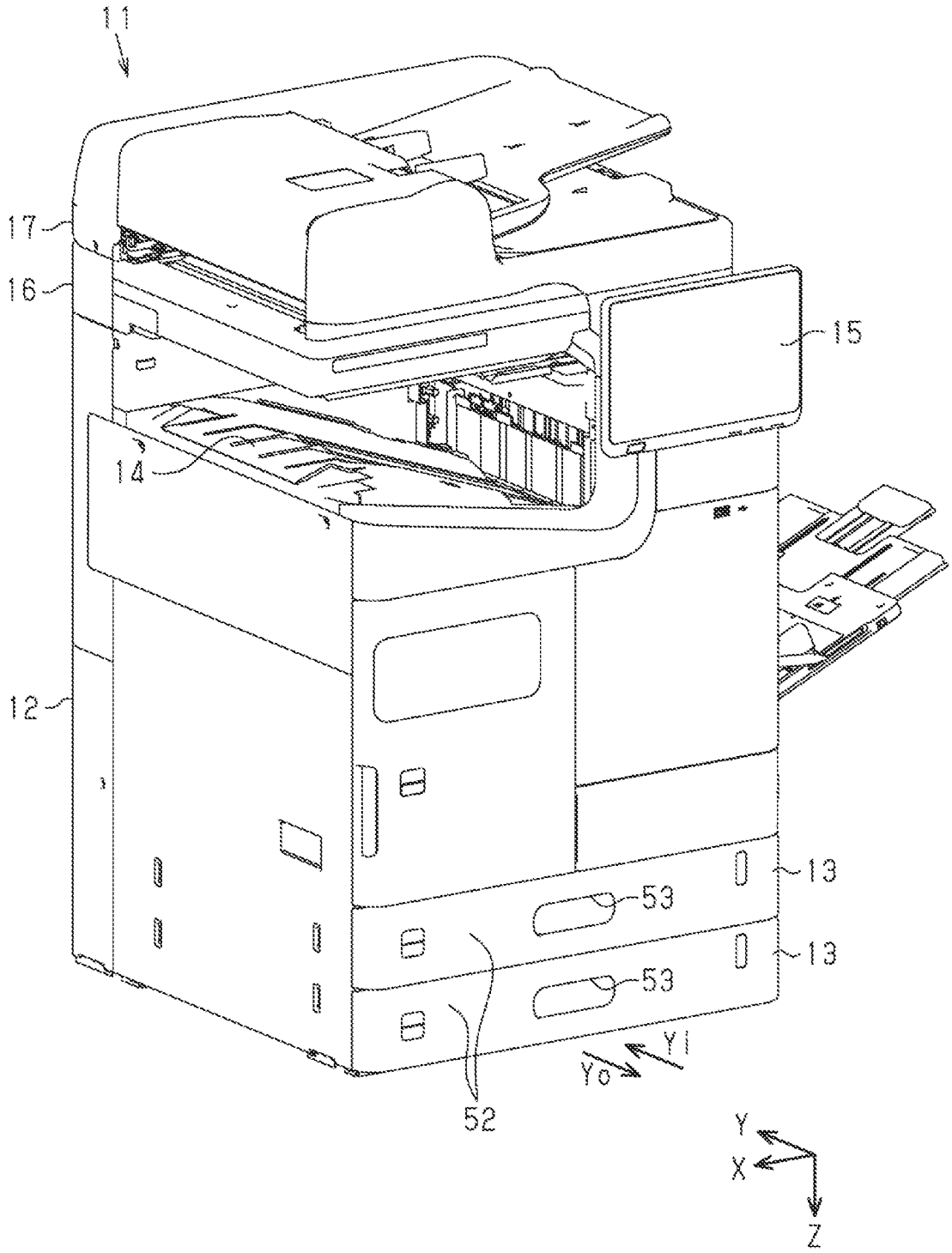
FIG. 1 is a perspective view of an embodiment of a recording apparatus.

An embodiment of a paper feeding cassette and a recording apparatus is described below with reference to the drawings. The recording apparatus is an ink-jet type printer that discharges ink, which is an example of a liquid, to perform printing on a sheet such as regular-size paper, irregular-size paper, a post card, a name card, a card, an envelope, and elongated paper. In the drawings, a Z axis represents the direction of gravity, and X and Y axes represent directions along a horizontal plane, assuming that a recording apparatus 11 is placed on the horizontal plane. The X axis, the Y axis, and the Z axis are orthogonal to one another. In the following description, a direction parallel to the X axis is also referred to as a width direction X, and a direction parallel to the Z axis is also referred to as a vertical direction Z. In the following description, as the recording apparatus 11 is viewed from the front, a front side is also referred to as a front, and a depth side is also referred to as a rear.

Recording Apparatus

As illustrated in FIG. 1, the recording apparatus 11 may include a main body 12 being an example of an apparatus, and one or more paper feeding cassettes 13. The recording apparatus 11 may include a stacker 14, a display unit 15, an image reading unit 16, and an automatic feeding unit 17.

The paper feeding cassette 13 can be inserted into the main body 12 and drawn out from the main body 12. The paper feeding cassette 13 may be inserted into and drawn out from the front of the recording apparatus 11 by a user. In the present embodiment, a direction in which the paper feeding cassette 13 is inserted into the main body 12 is also referred to as an insertion direction Yi, and a direction in which the paper feeding cassette 13 is drawn out from the main body 12 is also referred to as a drawing-out direction Yo. The drawing-out direction Yo is a direction opposite to the insertion direction Yi. The insertion direction Yi and the drawing-out direction Yo in the present embodiment are directions parallel to the Y axis. The width direction X is a vertical direction when the paper feeding cassette 13 is viewed from the front in a posture in which the paper feeding cassette 13 is mounted to the recording apparatus 11. Further, the width direction X is a direction intersecting the insertion direction Yi and the drawing-out direction Yo.

The display unit 15 may display information relating to the recording apparatus 11. The display unit 15 may be a touch panel for operating the recording apparatus 11. The display unit 15 may be provided facing the front. The image reading unit 16 reads an image of a document. The automatic feeding unit 17 feeds a document to the image reading unit 16.

Figure 2:
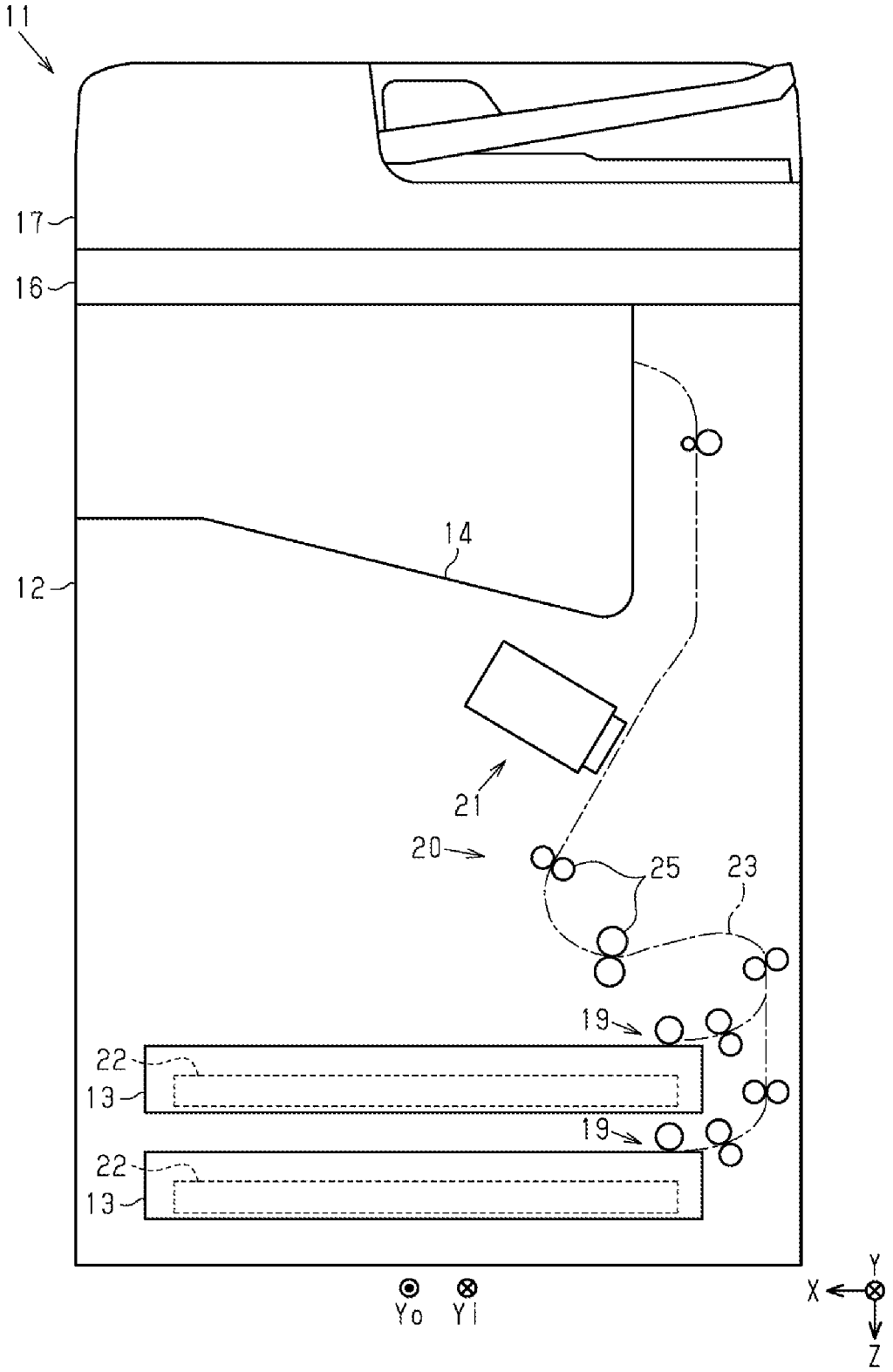
FIG. 2 is a schematic view of the recording apparatus.

As illustrated in FIG. 2, the recording apparatus 11 may include a feeding unit 19, a transport unit 20, and a recording unit 21. The recording apparatus 11 may include the same number of feeding units 19 as that of the paper feeding cassettes 13. In FIG. 2, a transport path 23 in which a sheet 22 is transported is indicated with the one-dot chain line. The transport path 23 couples the paper feeding cassette 13 and the stacker 14 to each other.

The feeding unit 19 feeds the sheet 22 placed on the paper feeding cassette 13. The feeding unit 19 feeds out the sheet 22 accommodated in the paper feeding cassette 13, one at a time from the corresponding paper feeding cassette 13 to the transport path 23.

The transport unit 20 transports the sheet 22 along the transport path 23. The transport unit 20 may include one or more transport roller pairs 25. The transport roller pair 25 rotates while sandwiching the sheet 22 therebetween to transport the sheet 22. The transport unit 20 discharges the transported sheet 22 to the stacker 14. The stacker 14 receives the discharged sheet 22.

The recording unit 21 performs recording on the sheet 22. The recording unit 21 of the present embodiment discharges a liquid from a nozzle (not illustrated) to perform recording. The recording unit 21 may be of a line type that performs recording on the transported sheet 22 with the recording unit 21 being in a stopped state. The recording unit 21 may be of a serial type that performs recording with the recording unit 21 moving relative to the stopped sheet 22.

Paper Feeding Cassette

In the drawings, the X axis, the Y axis, and the Z axis are indicated with the paper feeding cassette 13 being in a posture of being mounted to the recording apparatus 11.

Figure 3:
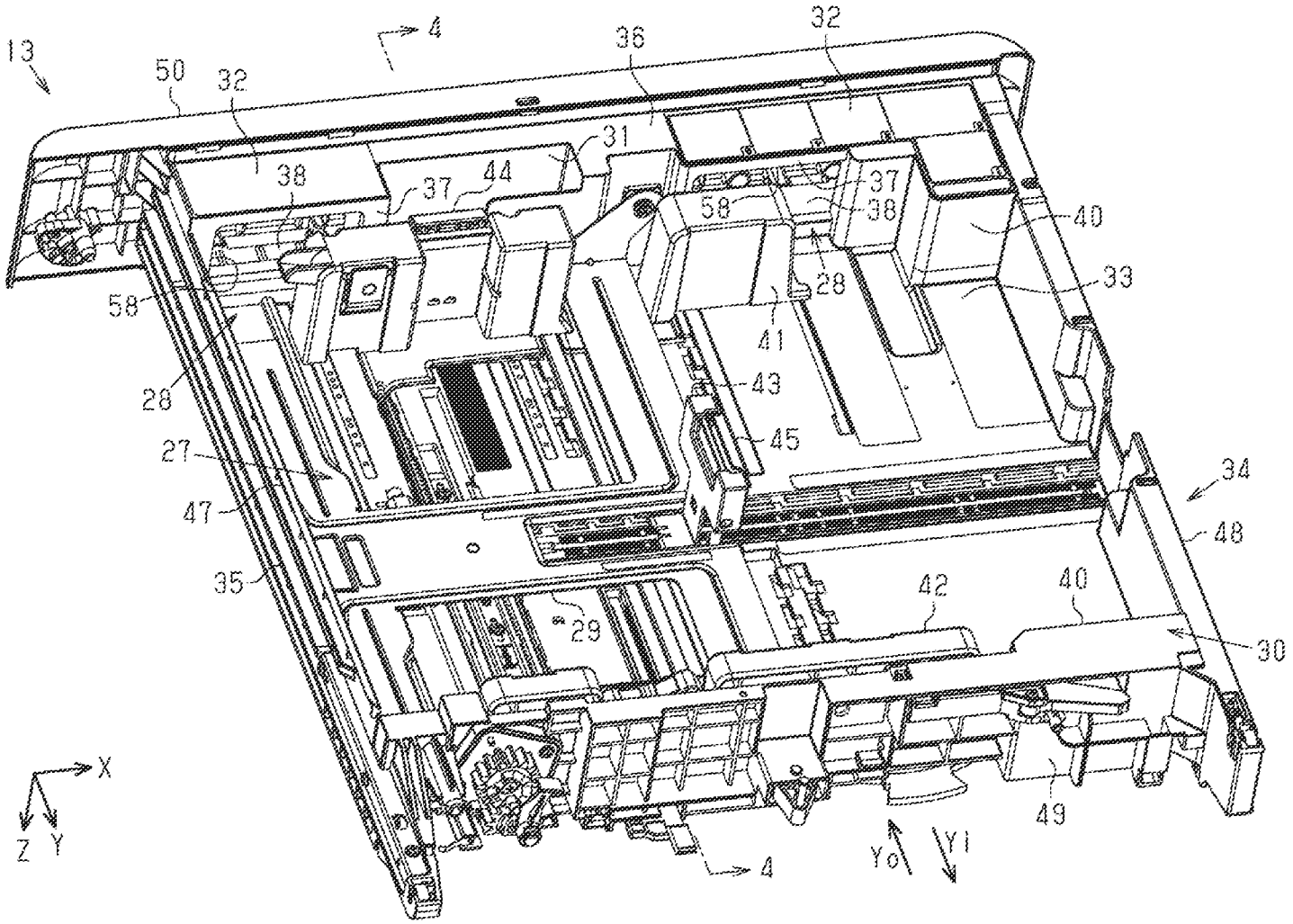
FIG. 3 is a perspective view of a paper feeding cassette.

As illustrated in FIG. 3, the paper feeding cassette 13 includes a placement unit 27 at which the sheet 22 is to be placed, and at least one accommodation unit 28 that accommodates an accommodated article. The paper feeding cassette 13 of the present embodiment includes two accommodation units 28. The paper feeding cassette 13 may include a hopper 29 and an edge guide 30. The paper feeding cassette 13 may include a recessed part 31. The paper feeding cassette 13 may include a guidance part 32, a first bottom plate 33, an outer wall 34, and a rail 35. The accommodation unit 28 includes a top plate 36 and a side wall 37. The accommodation unit 28 may include a second bottom plate 38.

The sheet 22 can be placed on the placement unit 27. To place means to put an article in a placed posture. The placement unit 27 of the present embodiment supports a bundle of a plurality of stacked sheets 22. The placement unit 27 and the accommodation unit 28 are provided at positions different from each other. The placement unit 27 and the accommodation unit 28 of the present embodiment are provided at positions shifted from each other in the insertion direction Yi.

The hopper 29 lifts up at least a part of the sheet 22 placed on the placement unit 27 to bring the sheet 22 closer to the feeding unit 19.

The edge guide 30 may include a fixed guide 40, a front guide 41, a rear guide 42, and a width guide 43. The edge guide 30 may include a first operation part 44 and a second operation part 45, which are examples of an operation part. The edge guide 30 guides the edge of the sheet 22 placed on the placement unit 27.

The fixed guide 40 is not movable. The fixed guide 40 may be provided in accordance with a maximum size that can be placed on the placement unit 27. The fixed guide 40 may be provided on both sides in the insertion direction Yi. The fixed guide 40 may guide the leading edge and the trailing edge of the sheet 22 having the maximum size.

The front guide 41, the rear guide 42, and the width guide 43 are movable guides that can slidably move along the first bottom plate 33. The front guide 41, the rear guide 42, and the width guide 43 are moved in accordance with a size of the sheet 22 placed on the placement unit 27. The front guide 41 and the rear guide 42 are movable in the insertion direction Yi and the drawing-out direction Yo. The width guide 43 is movable reciprocally in the width direction X.

The front guide 41 guides the leading edge of the sheet 22 placed on the placement unit 27. When the front guide 41 moves in the drawing-out direction Yo to reach the end of the movable region, the front guide 41 may be at the same position as that of the fixed guide 40 in the drawing-out direction Yo. The rear guide 42 guides the trailing edge of the sheet 22 placed on the placement unit 27. When the rear guide 42 moves in the insertion direction Yi to reach the end of the movable region, the rear guide 42 may be at the same position as the fixed guide 40 in the insertion direction Yi. Of the edges of the sheet 22, the width guide 43 guides an edge on a side opposite, in the width direction X, to the side lifted up by the hopper 29.

The front guide 41 and the rear guide 42 may move in a linked manner. The front guide 41 and the rear guide 42 that are linked with each other move in the opposite directions. Specifically, when the front guide 41 moves in the insertion direction Yi, the rear guide 42 moves in the drawing-out direction Yo. When the front guide 41 moves in the drawing-out direction Yo, the rear guide 42 moves in the insertion direction Yi.

The first operation part 44 may be provided at the front guide 41. The first operation part 44 is operated to move the front guide 41 and the rear guide 42 in the drawing-out direction Yo and the insertion direction Yi.

The second operation part 45 may be provided at the width guide 43. The second operation part 45 is operated to move the width guide 43 in the width direction X.

The recessed part 31 is recessed relative to the top plate 36. The recessed part 31 may be provided at a position at which the recessed part 31 overlaps with at least a part of the accommodation unit 28 in the insertion direction Yi. At least a part of the recessed part 31 may overlap with the accommodation unit 28 in the insertion direction Yi. The recessed part 31 may be provided at the same position as that of at least a part of the accommodation unit 28 in the insertion direction Yi. The front end of the recessed part 31 may be positioned in front of the rear end of the accommodation unit 28. The recessed part 31 and the accommodation unit 28 may be side by side in the width direction X. As viewed in the width direction X, at least a part of the recessed part 31 overlaps with the accommodation unit 28.

The recessed part 31 and the first operation part 44 may be side by side in the insertion direction Yi. The recessed part 31 and the first operation part 44 may be provided at the same position in the width direction X. At least a part of the recessed part 31 may be provided at a position at which the part of the recessed part 31 overlaps with the first operation part 44 as viewed in the insertion direction Yi. At least a part of the recessed part 31 may be provided at a position at which the part of the recessed part 31 overlaps with the first operation part 44 in the width direction X. The recessed part 31 is positioned on the opposite side of the placement unit 27 with respect to the first operation part 44. The recessed part 31 is positioned in front of the first operation part 44. A view in the width direction X includes a perspective view.

The guidance part 32 may be provided at the top plate 36. The guidance part 32 gives guidance about an operation method to a user. For example, the guidance part 32 may give guidance about a method of setting the sheet 22 in the paper feeding cassette 13, a method of mounting the paper feeding cassette 13 to the recording apparatus 11, a method of removing the sheet 22 remaining in the transport path 23, cautions, and the like.

The outer wall 34 intersects the first bottom plate 33. The outer wall 34 may include a right wall 47, a left wall 48, a rear wall 49, and a front wall 50. The outer wall 34 and the first bottom plate 33 may be integrally formed. The outer wall 34 may be formed by combining a plurality of members.

When the paper feeding cassette 13 is viewed from the front in the insertion direction Yi, the right wall 47 is positioned on the right side of the placement unit 27 and the accommodation unit 28, whereas the left wall 48 is positioned on the left side of the placement unit 27 and the accommodation unit 28. The right wall 47 and the left wall 48 are provided away from each other to sandwich the placement unit 27 in the width direction X. The rear wall 49 is positioned behind the placement unit 27 and the accommodation unit 28. The front wall 50 is positioned in front of the placement unit 27 and the accommodation unit 28.

The paper feeding cassette 13 may include a plurality of rails 35. The rail 35 may be provided on the outer side of each of the right wall 47 and the left wall 48. When the paper feeding cassette 13 moves with respect to the main body 12, the rail 35 guides the paper feeding cassette 13. The insertion direction Yi and the drawing-out direction Yo are also directions in which the rail 35 extends.

Figure 4:
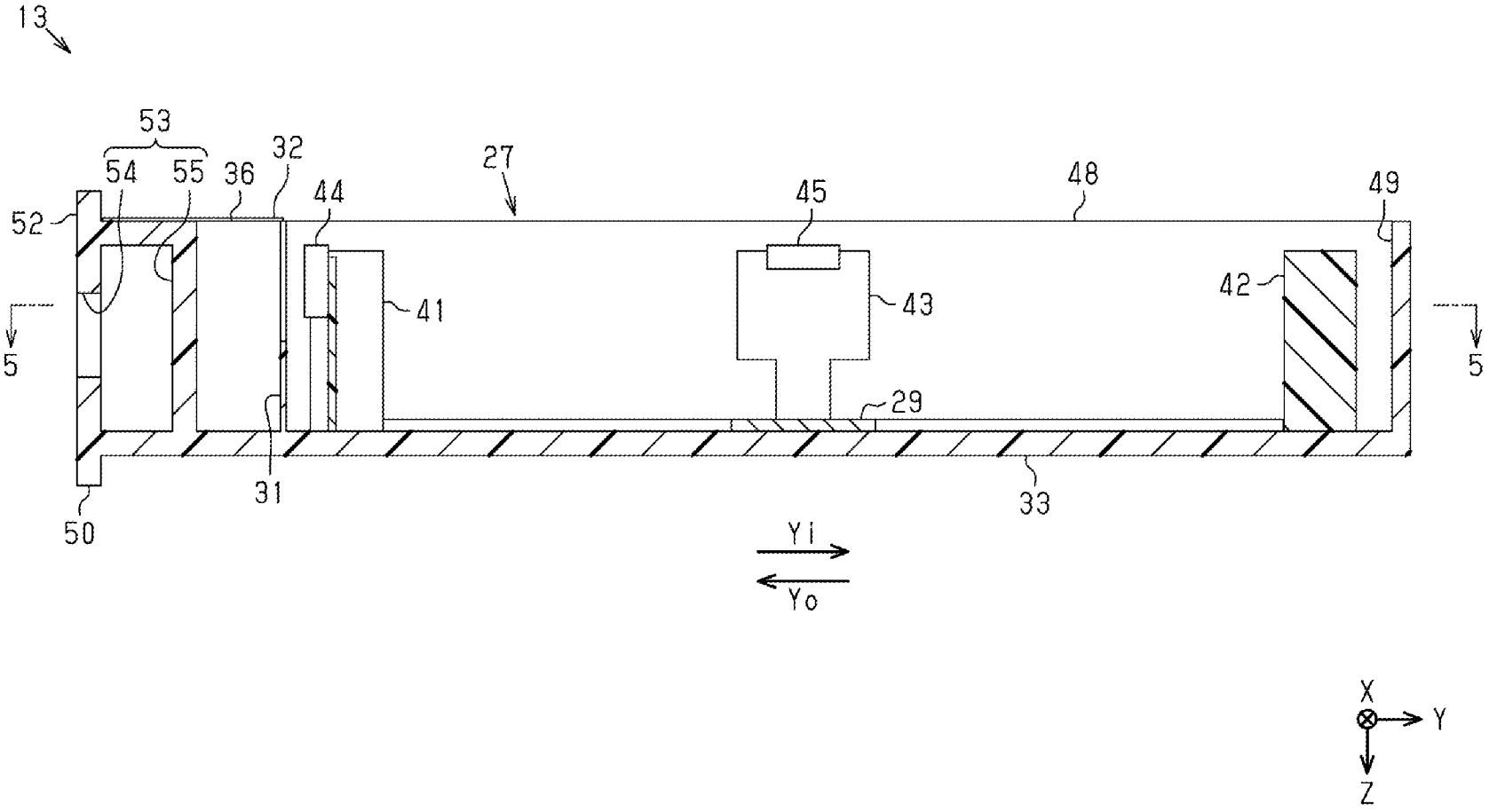
FIG. 4 is a cross-sectional view taken along the line 4-4 in FIG. 3.

As illustrated in FIG. 4, the front wall 50 may include a front surface 52 and a hand grip part 53. The paper feeding cassette 13 is exposed to the outside of the front surface 52 in a state in which the paper feeding cassette 13 is mounted to the recording apparatus 11. The hand grip part 53 may be provided at the front surface 52. The hand grip part 53 may include a hole 54 opened in the front surface 52, and a rear chamber 55 provided in the depth of the hole 54. When the rear chamber 55 is larger than the hole 54 in the width direction X and the vertical direction Z, a user can easily place the hand on the edge of the hole 54 and draw out the paper feeding cassette 13.

Figure 5:
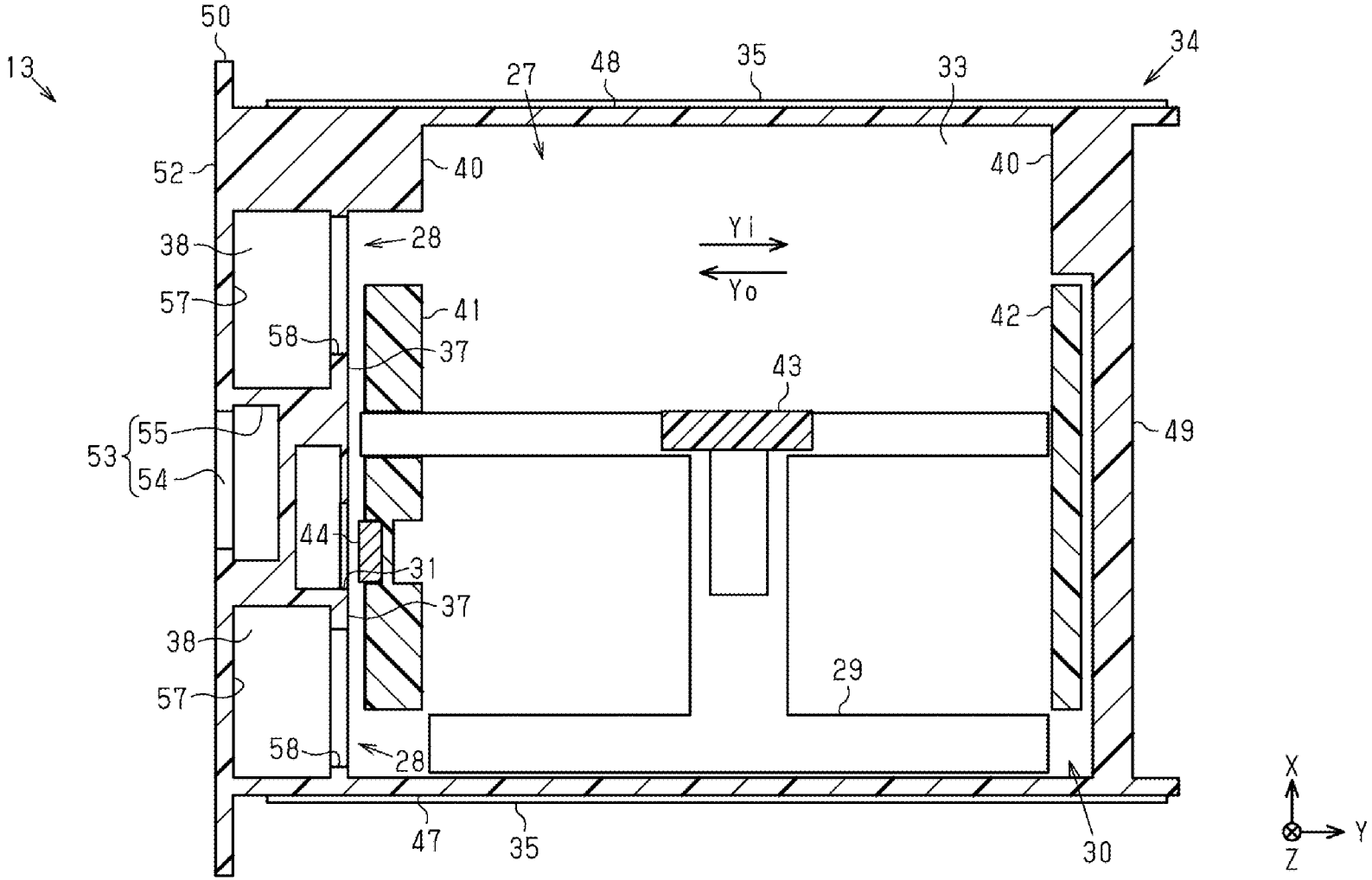
FIG. 5 is a cross-sectional view taken along the line 5-5 in FIG. 4.

As illustrated in FIG. 5, the hand grip part 53 may be provided between two accommodation units 28 in the width direction X. The hand grip part 53 may be provided at a position at which the hand grip part 53 overlaps with at least a part of the accommodation unit 28 in the insertion direction Yi. The hand grip part 53 may be provided at the same position as that of at least a part of the accommodation unit 28 in the insertion direction Yi. In the present embodiment, the rear end of the rear chamber 55 is positioned behind the front end of the accommodation unit 28. The hand grip part 53 and the accommodation unit 28 are side by side in the width direction X. As the hand grip part 53 is viewed in the width direction X, the rear chamber 55 overlaps with the accommodation unit 28.

A part of the outer wall 34 may form the accommodation unit 28. Specifically, the front wall 50 and the right wall 47 form the accommodation unit 28 that is on the right side as viewed in the insertion direction Yi. The front wall 50 and the left wall 48 form the accommodation unit 28 that is on the left side as viewed in the insertion direction Yi.

The accommodation unit 28 includes an accommodation chamber 57. The accommodation chamber 57 may be defined by the outer wall 34, the top plate 36, the side wall 37, and the second bottom plate 38. The side wall 37 is positioned between the accommodation chamber 57 and the placement unit 27 in the insertion direction Yi. The side wall 37 is a wall on the rear side of the accommodation chamber 57. The side wall 37 functions as a partition between the accommodation chamber 57 and the placement unit 27. The side wall 37 includes an opening part 58 opened toward an inner side of the paper feeding cassette 13. The opening part 58 allows communication between the accommodation chamber 57 and the placement unit 27. The opening part 58 may be provided at a position higher than the second bottom plate 38.

Figure 6:
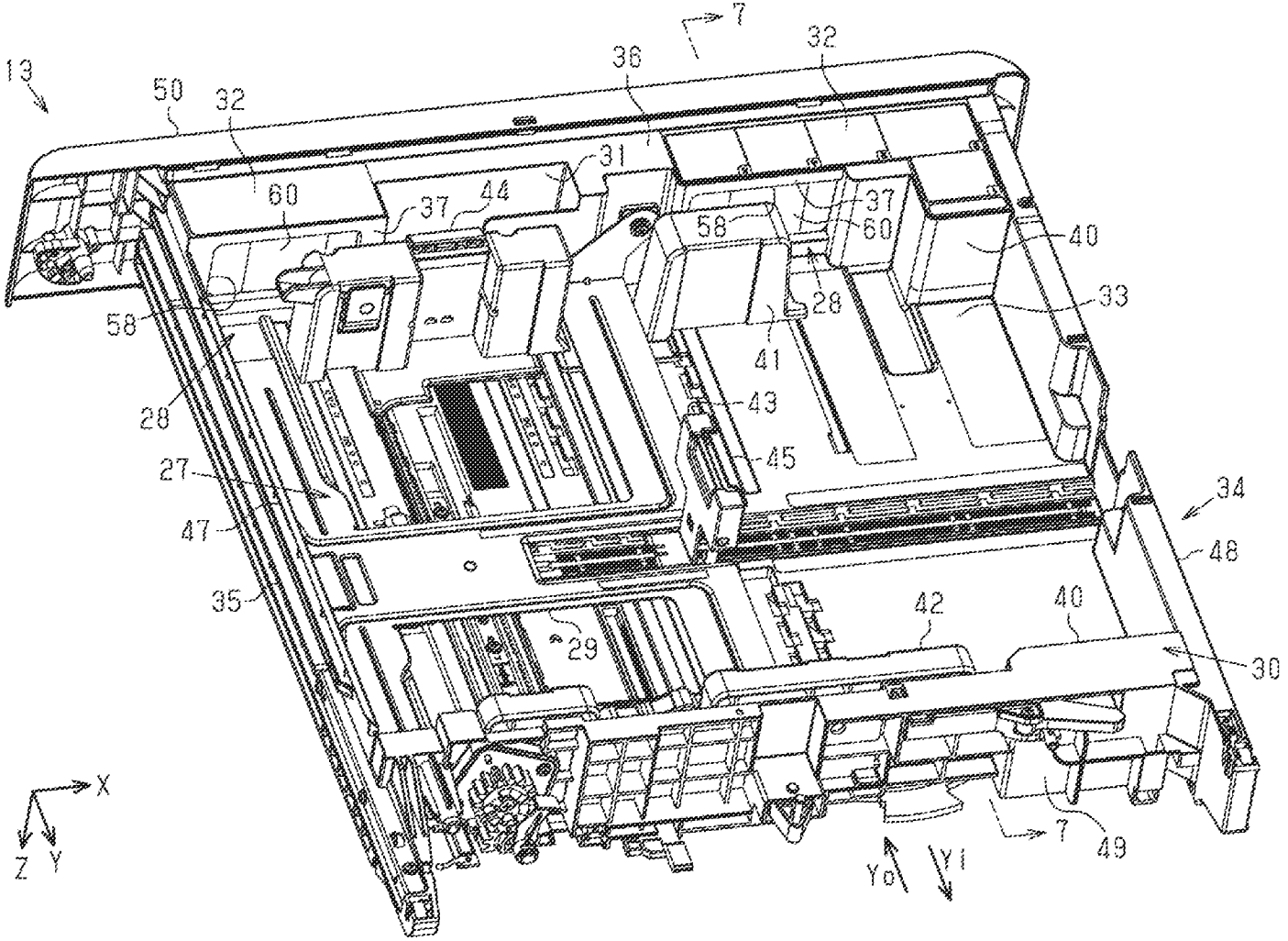
FIG. 6 is a perspective view of the paper feeding cassette with a drying agent accommodated therein.
Figure 7:
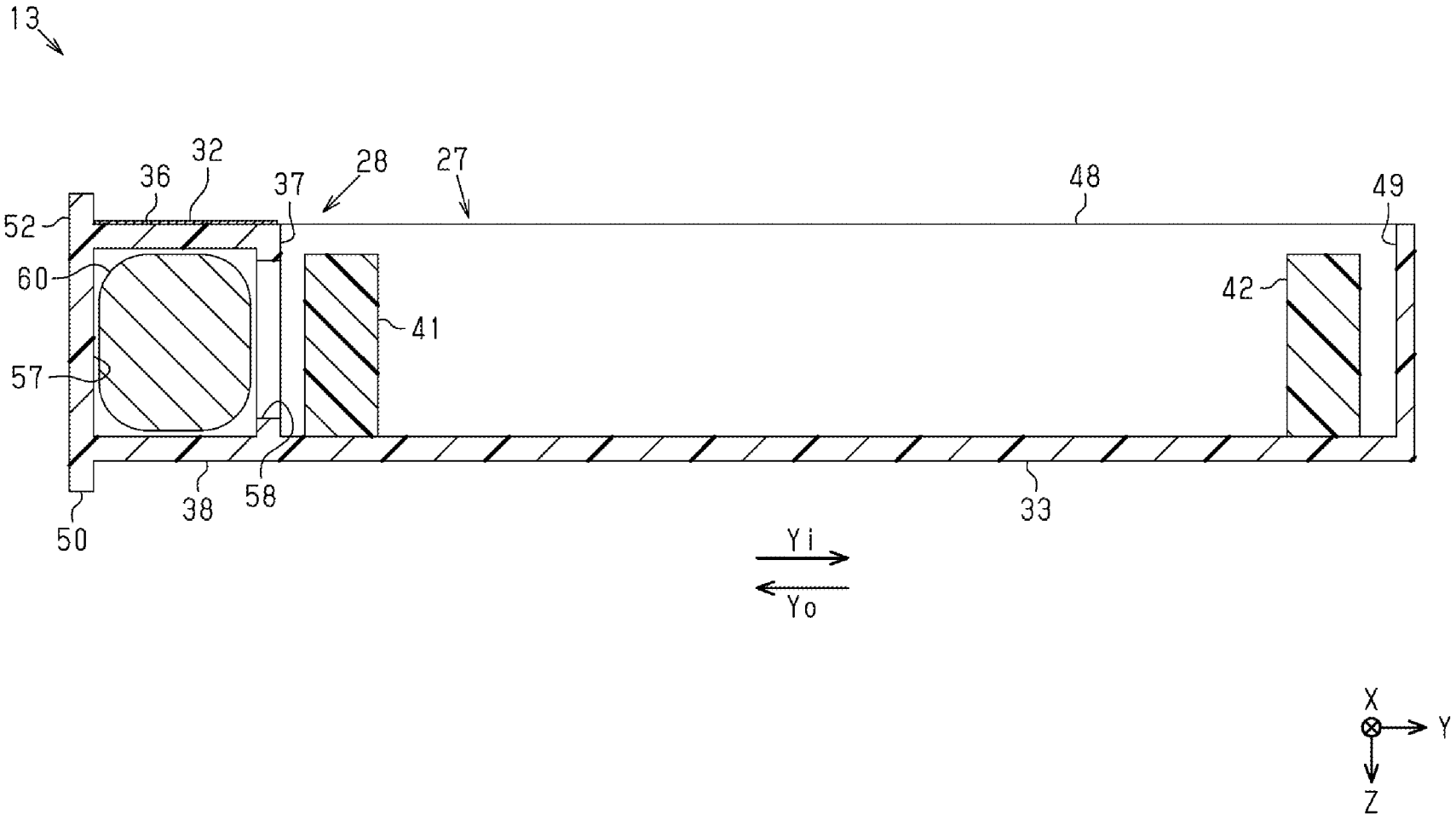
FIG. 7 is a cross-sectional view taken along the line 7-7 in FIG. 6.

As illustrated in FIG. 6 and FIG. 7, the side wall 37 intersects the top plate 36. The side wall 37 may intersect the second bottom plate 38. The second bottom plate 38 may be formed integrally with the first bottom plate 33.

The accommodation unit 28 may accommodate a drying agent 60. The drying agent 60 can be loaded into and unloaded from the accommodation chamber 57 through the opening part 58. At least a part of the accommodation unit 28 may overlap with the front guide 41 in the drawing-out direction Yo.

Actions of Embodiment

The actions of the present embodiment are described.

The drying agent 60 accommodated in the accommodation unit 28 absorbs moisture in the paper feeding cassette 13. The front guide 41 moves in the insertion direction Yi to be away from the accommodation unit 28. When the maximum distance from the accommodation unit 28 to the front guide 41 in the insertion direction Yi is larger than the dimension of the accommodation chamber 57, the drying agent 60 can easily be replaced.

Effects of Embodiment

The effects of the present embodiment are described.

(1) The accommodation unit 28 includes the top plate 36 and the side wall 37. The side wall 37 includes the opening part 58 opened toward the inner side of the paper feeding cassette 13. In other words, the side of the accommodation unit 28 is opened, whereas the upper side thereof is closed. Thus, the risk that an article accommodated in the accommodation unit 28 may protrude upward is suppressed. Therefore, insertion and drawing-out can be smoothly performed.

(2) The first bottom plate 33 and the second bottom plate 38 are integrated with each other. With this, the configuration can be simplified. (3) A part of the outer wall 34 forms the accommodation unit 28. With this, the configuration can be simplified.

(4) At least a part of the accommodation unit 28 overlaps with the hand grip part 53 in the insertion direction Yi. Therefore, size reduction can be achieved as compared to a case in which the accommodation unit 28 and the hand grip part 53 do not overlap with each other in the insertion direction Yi.

(5) At least a part of the accommodation unit 28 overlaps with the front guide 41 in the drawing-out direction Yo. Thus, even when an article accommodated in the accommodation unit 28 protrudes, the front guide 41 can press down the article.

(6) The recessed part 31 is provided at a position at which the recessed part 31 overlaps with at least a part of the accommodation unit 28 in the insertion direction Yi and at which the recessed part 31 is side by side with the first operation part 44 in the insertion direction Yi. Thus, even when the front guide 41 is at a position close to the accommodation unit 28, a space for operating the first operation part 44 can be secured.

(7) The drying agent 60 is accommodated in the accommodation unit 28 including the opening part 58 in the side wall 37. The opening part 58 is opened toward the inner side of the paper feeding cassette 13. With this, drying of the sheet 22 can be efficiently performed. Further, the drying agent 60 absorbs moisture to expand, but the drying agent 60 does not protrude upward because the upper side of the accommodation unit 28 is closed.

(8) The guidance part 32 is provided at the top plate 36. With this, the accommodation unit 28 can be efficiently utilized.

Modified Examples

The present embodiment can be modified and implemented as follows. The present embodiment and the following modified examples can be combined and implemented within a technically consistent range.

Figure 8:
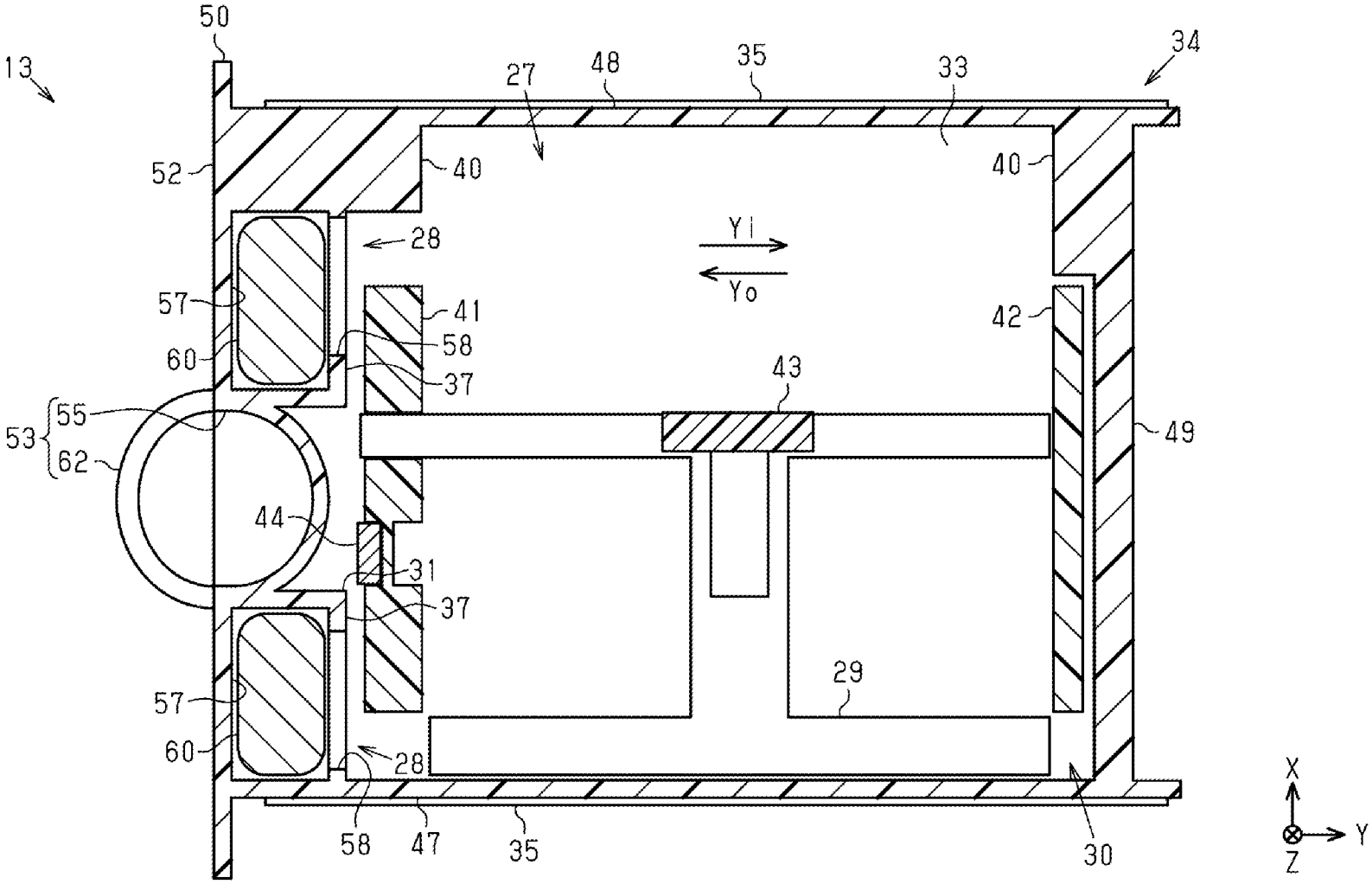
FIG. 8 is a cross-sectional view of a paper feeding cassette in a modified example.

- As illustrated in FIG. 8, the hand grip part 53 may include a handle 62 and the rear chamber 55. The handle 62 protrudes from the front surface 52. The rear chamber 55 is recessed relative to the front surface 52. The rear chamber 55 is provided, and hence the hand is easily placed on the handle 62.
- The opening part 58 may be provided with a removable or openable/closable fence, a lattice, or the like.
- The paper feeding cassette 13 may include one or a plurality of accommodation units 28. A configuration may be adopted in which at least two accommodation units 28, of the plurality of accommodation units 28, are in communication with the accommodation chamber 57.
- The accommodation unit 28 may include a plurality of opening parts 58.
- The side wall 37 may be curved.
- The accommodation unit 28 may be provided at a position different from that of the placement unit 27 in the width direction X.
- The accommodation unit 28 may be provided behind the placement unit 27.
- The guidance part 32 may be provided at a position different from that of the top plate 36. The guidance part 32 may be provided at the first bottom plate 33, the edge guide 30, the front wall 50, or the like.
- The accommodation unit 28 may accommodate an article relating to the paper feeding cassette 13 or the recording apparatus 11, such as a maintenance tool, a replacement component, and an operating manual.
- The paper feeding cassette 13 need not be provided with the recessed part 31. The first operation part 44 and the second operation part 45 may be provided separately from the edge guide 30.
- The recessed part 31 may be provided at a position at which the recessed part 31 is side by side with the second operation part 45 in the width direction X.
- The edge guide 30 may be removable. The removed edge guide 30 may be attached in accordance with a size of the sheet 22.
- The edge guide 30 and the accommodation unit 28 may be provided at positions shifted from each other in the width direction X.
- The accommodation unit 28 and the outer wall 34 may be formed by different members. The first bottom plate 33 and the second bottom plate 38 may be formed by different members. The first bottom plate 33 and the outer wall 34 may be formed by different members. The second bottom plate 38 and the outer wall 34 may be formed by different members.
- The apparatus to which the paper feeding cassette 13 is mounted may be a paper feeding apparatus that feeds the sheet 22 to the recording apparatus 11, a facsimile machine, a dry-type papermaking machine, or the like.
- The recording apparatus 11 may be a laser printer, a thermal printer, a dot impact printer, a digital printing machine, or the like.
- The recording apparatus 11 may be a liquid jetting apparatus that jets or ejects a liquid other than ink to perform recording. The state of the liquid ejected from the liquid jetting apparatus in a form of a minute amount of droplet is assumed to include a particulate form, a teardrop form, and a tailing filiform form. The liquid herein may be any material that can be jetted from the liquid jetting apparatus. For example, the liquid may be any matter in a state of being in a liquid phase, and is assumed to include a liquid body having high or low viscosity, as well as a fluid body such as sol, gel water, other inorganic solvents, an organic solvent, a solution, a liquid resin, a liquid metal, and a metal melt. The liquid includes not only liquid as a single state of the substance, but also includes particles of a functional material made of a solid such as pigment or metal particles dissolved in a solvent, dispersed or mixed in a solvent, and the like. Typical examples of the liquid include ink described in the embodiment above and liquid crystal. Here, ink is assumed to include a general aqueous ink and a solvent ink, as well various liquid compositions such as gel ink and hot-melt ink. Examples of the liquid jetting apparatus include an apparatus that jets a liquid including, in a dispersed or dissolved form, a material such as an electrode material and a color material used in manufacture of liquid crystal displays, electroluminescent displays, surface emitting displays, color filters and the like in a dispersed or dissolved form. The liquid jetting apparatus may be an apparatus that jets bioorganic substances used for biochip manufacturing, an apparatus that is used as a precision pipette and jets a liquid to be a sample, a recording apparatus, a micro dispenser, or the like. The liquid jetting apparatus may be an apparatus that jets lubricant to a precision machine such as a clock or a camera in a pinpoint manner, or an apparatus that jets a transparent resin liquid such as ultraviolet curable resin or the like on a substrate for forming a tiny hemispherical lens, optical lens, or the like used for an optical communication element and the like. The liquid jetting apparatus may be an apparatus that jets an etching liquid such as an acid or an alkali for etching a substrate or the like.

Definitions

The expression "at least one" used in the present specification indicates "one or more" desired options. As an example, when the number of options is two, the expression "at least one" used in the present specification indicates "only one option" or "both of the two options". As another example, when the number of options is three or more, the expression "at least one" used in the present specification indicates "only one option" or "a combination of two or more freely selected options".

SUPPLEMENTARY NOTES

Hereinafter, technical concepts and effects thereof that are understood from the above-described embodiment and modified examples are described.

(A) A paper feeding cassette is a paper feeding cassette configured to be inserted into an apparatus and drawn out from the apparatus. The paper feeding cassette includes: a placement unit at which a sheet is to be placed, and at least one accommodation unit. The accommodation unit includes a top plate and a side wall intersecting the top plate. The side wall includes an opening part opened toward an inner side of the paper feeding cassette. The placement unit and the accommodation unit are provided at positions different from each other.

According to this configuration, the accommodation unit includes the top plate and the side wall. The side wall includes the opening part opened toward the inner side of the paper feeding cassette. In other words, the side of the accommodation unit is opened, whereas the upper side thereof is closed. Thus, the risk that an article accommodated in the accommodation unit may protrude upward is suppressed. Therefore, insertion and drawing-out can be smoothly performed.

(B) The paper feeding cassette may include a first bottom plate and an outer wall intersecting the first bottom plate, in which the accommodation unit may include a second bottom plate intersecting the side wall, and the first bottom plate and the second bottom plate may be integrated with each other.

According to this configuration, the first bottom plate and the second bottom plate are integrated with each other. With this, the configuration can be simplified.

(C) The paper feeding cassette may include a first bottom plate and an outer wall intersecting the first bottom plate, in which a part of the outer wall may form the accommodation unit.

According to this configuration, a part of the outer wall forms the accommodation unit. With this, the configuration can be simplified.

(D) In the paper feeding cassette, the outer wall may include a front wall provided with a hand grip part, and at least a part of the accommodation unit may overlap with the hand grip part in an insertion direction in which the paper feeding cassette is inserted into the apparatus.

According to this configuration, the accommodation unit is provided with at least a part thereof overlapping with the hand grip part in the insertion direction. Therefore, size reduction can be achieved as compared to a case in which the accommodation unit and the hand grip part are provided at positions at which the accommodation unit and the hand grip part do not overlap with each other in the insertion direction.

(E) The paper feeding cassette may include an edge guide configured to guide an edge of the sheet to be placed on the placement unit, in which the edge guide may be configured to move in a drawing-out direction in which the paper feeding cassette is drawn out from the apparatus and the insertion direction, and at least a part of the accommodation unit may overlap with the edge guide as viewed in the drawing-out direction.

According to this configuration, at least a part of the accommodation unit overlaps with the edge guide in the drawing-out direction. Thus, even when an article accommodated in the accommodation unit protrudes, the edge guide can press down the article.

(F) The paper feeding cassette may include a recessed part recessed relative to the top plate, in which at least a part of the recessed part may overlap with the accommodation unit in the insertion direction, the edge guide may include an operation part configured to be operated when the edge guide is moved in the drawing-out direction and the insertion direction, and the recessed part and the operation part may be side by side in the insertion direction.

According to this configuration, the recessed part is provided at a position that is the same position as that of at least a part of the accommodation unit in the insertion direction and at which the recessed part is side by side with the operation part in the insertion direction. Thus, even when the edge guide is at a position close to the accommodation unit, a space for operating the operation part can be secured.

(G) In the paper feeding cassette, the accommodation unit may accommodate a drying agent.

According to this configuration, the drying agent is accommodated in the accommodation unit including the opening part in the side wall. The opening part is opened toward the inner side of the paper feeding cassette. With this, drying of the sheet can be efficiently performed.

(H) The paper feeding cassette may include a guidance part provided at the top plate, in which the guidance part may give guidance about an operation method to a user.

According to this configuration, the guidance part is provided at the top plate. With this, the accommodation unit can be efficiently utilized.

(I) A recording apparatus may include the paper feeding cassette having the above-mentioned configuration, a feeding unit configured to feed the sheet to be placed on the paper feeding cassette, and a recording unit configured to perform recording on the sheet.

According to this configuration, an effect the same as or similar to that of the paper feeding cassette can be achieved.

What is claimed is:

1. A paper feeding cassette configured to be inserted into an apparatus and drawn out from the apparatus, the paper feeding cassette comprising:

a placement unit at which a sheet is to be placed; and at least one accommodation unit configured to accommodate an accommodated article, wherein the accommodation unit includes a top plate and a side wall intersecting the top plate, the side wall includes an opening part opened toward an inner side of the paper feeding cassette, and the placement unit and the accommodation unit are provided at positions different from each other.

2. The paper feeding cassette according to claim 1, further comprising:

a first bottom plate; and an outer wall intersecting the first bottom plate, wherein the accommodation unit includes a second bottom plate intersecting the side wall and the first bottom plate and the second bottom plate are integrated with each other.

3. The paper feeding cassette according to claim 1, further comprising:

a first bottom plate; and an outer wall intersecting the first bottom plate, wherein a part of the outer wall forms the accommodation unit.

4. The paper feeding cassette according to claim 3, wherein the outer wall includes a front wall provided with a hand grip part and at least a part of the accommodation unit overlaps with the hand grip part in an insertion direction in which the paper feeding cassette is inserted into the apparatus.

5. The paper feeding cassette according to claim 4, further comprising an edge guide configured to guide an edge of the sheet to be placed on the placement unit, wherein the edge guide is configured to move in a drawing-out direction in which the paper feeding cassette is drawn out from the apparatus and the insertion direction and at least a part of the accommodation unit overlaps with the edge guide as viewed in the drawing-out direction.

6. The paper feeding cassette according to claim 5, further comprising a recessed part recessed relative to the top plate, wherein at least a part of the recessed part overlaps with the accommodation unit in the insertion direction, the edge guide includes an operation part configured to be operated when the edge guide is moved in the drawing-out direction and the insertion direction, and the recessed part and the operation part are side by side in the insertion direction.

7. The paper feeding cassette according to claim 1, wherein the accommodation unit accommodates a drying agent.

8. The paper feeding cassette according to claim 1, further comprising a guidance part provided at the top plate, wherein the guidance part gives guidance about an operation method to a user.

9. A recording apparatus comprising:

the paper feeding cassette according to claim 1;

a feeding unit configured to feed the sheet to be placed on the paper feeding cassette; and a recording unit configured to perform recording on the sheet.

* * * * *